US010969085B1

(12) United States Patent
Saltzer

(10) Patent No.: US 10,969,085 B1
(45) Date of Patent: Apr. 6, 2021

(54) DECORATIVE COVER ENCLOSURE FOR MOVING YOKE INTELLIGENT LIGHTING FIXTURES

(71) Applicant: Matthew Saltzer, Harrisburg, PA (US)

(72) Inventor: Matthew Saltzer, Harrisburg, PA (US)

( * ) Notice: Subject to any disclaimer, the term of this patent is extended or adjusted under 35 U.S.C. 154(b) by 0 days.

(21) Appl. No.: 16/901,194

(22) Filed: Jun. 15, 2020

(51) Int. Cl.

| | |
|---|---|
| ***F21V 3/00*** | (2015.01) |
| ***F21V 17/06*** | (2006.01) |
| ***F21V 3/02*** | (2006.01) |
| ***F21V 14/02*** | (2006.01) |
| ***F21V 17/12*** | (2006.01) |
| ***F21V 29/83*** | (2015.01) |

(52) U.S. Cl.
CPC ..... *F21V 17/06* (2013.01); *F21V 3/02* (2013.01); *F21V 14/02* (2013.01); *F21V 17/12* (2013.01); *F21V 29/83* (2015.01)

(58) Field of Classification Search
CPC ..... F21V 17/06; F21V 17/12; F21V 14/02; F21V 29/83; F21V 3/02
USPC ..... 362/363
See application file for complete search history.

(56) References Cited

U.S. PATENT DOCUMENTS

| | | | | |
|---|---|---|---|---|
| 2013/0201703 | A1* | 8/2013 | Dalsgaard | F21V 21/26 362/427 |
| 2016/0215961 | A1* | 7/2016 | Kjeldsen | F21V 5/007 |
| 2019/0250485 | A1* | 8/2019 | Richins | F16M 13/022 |
| 2019/0316762 | A1* | 10/2019 | Rasmussen | F21V 3/02 |

* cited by examiner

*Primary Examiner* — Ali Alavi
(74) *Attorney, Agent, or Firm* — Steven R. Fairchild

(57) ABSTRACT

The present invention are decorative covers for an intelligent moving light fixture. These covers provide an attractive appeal by adding an attractive aspect, surface reflection, them-related and geometric shapes that increase the ambiance and decor. These enclose the U-shaped, panning yoke as well as the football-shaped, tilting central light engine of an intelligent moving yoke light fixture.

12 Claims, 4 Drawing Sheets

DECORATIVE COVER ENCLOSURE FOR MOVING YOKE INTELLIGENT LIGHTING FIXTURES

BACKGROUND OF THE INVENTION

1. Field of Invention

The present invention generally relates to decorative covers for use with moving yoke intelligent lighting fixtures. These covers provide an attractive appeal to the lighting fixtures by replacing the exterior appearance of the otherwise dull fixture with a theme-related or geometric shape that's decorated with reflective surfaces, paint, designs, color, or even LEDs, all to transform the fixture from a light producing appliance to actually be an attractive addition to the decor.

2. Description of Related Art

The light fixtures currently on the market are entirely functional and lack visual appeal. There are a few models with a ring of LEDs around the aperture but otherwise, the visual "trimming" of fixtures is either solid black or solid white.

In the past, decorations have been separate from lighting fixtures. Lighting has been used to illuminate the decorations as well as create a show using beams of light.

Existing fixtures are designed with a black or white molded opaque plastic that is shaped to closely fit the fixture, keeping stray light energy in as well as dust, debris and fingers out. The existing molded covers serve the purpose of finishing the product much like the hood of a car over its engine.

The prior art does not describe the present invention.

SUMMARY OF THE INVENTION

A decorative cover for an intelligent moving yoke light fixture.

The decorative cover of [0006] wherein it is a mirrored globe.

The decorative cover of [0007] wherein it has at least one ventilation hole on the top and one on the bottom.

The decorative cover of [0008] wherein it has four ventilation holes.

The intelligent moving yoke light fixture of [0006] wherein it has at least two mounting brackets secured to a panning pane of said intelligent moving yoke light fixture.

The mounting brackets of [0010] wherein each said mounting bracket has two screw holes for the securement of a decorative cover.

The decorative cover of [0011] wherein it has at least four screw holes.

The decorative cover of [0012] wherein mounting brackets are secured to said decorative cover using at least one screw in each corresponding screw hole.

The decorative cover of [0006] wherein it is a large cube.

BRIEF DESCRIPTION OF THE DRAWINGS

FIG. One depicts a standard intelligent moving light fixture with two mounting brackets for the attachment of a decorative cover.

FIG. Two depicts the underside of a decorative cover (mirrored globe) as used in the present invention.

Figure 1:
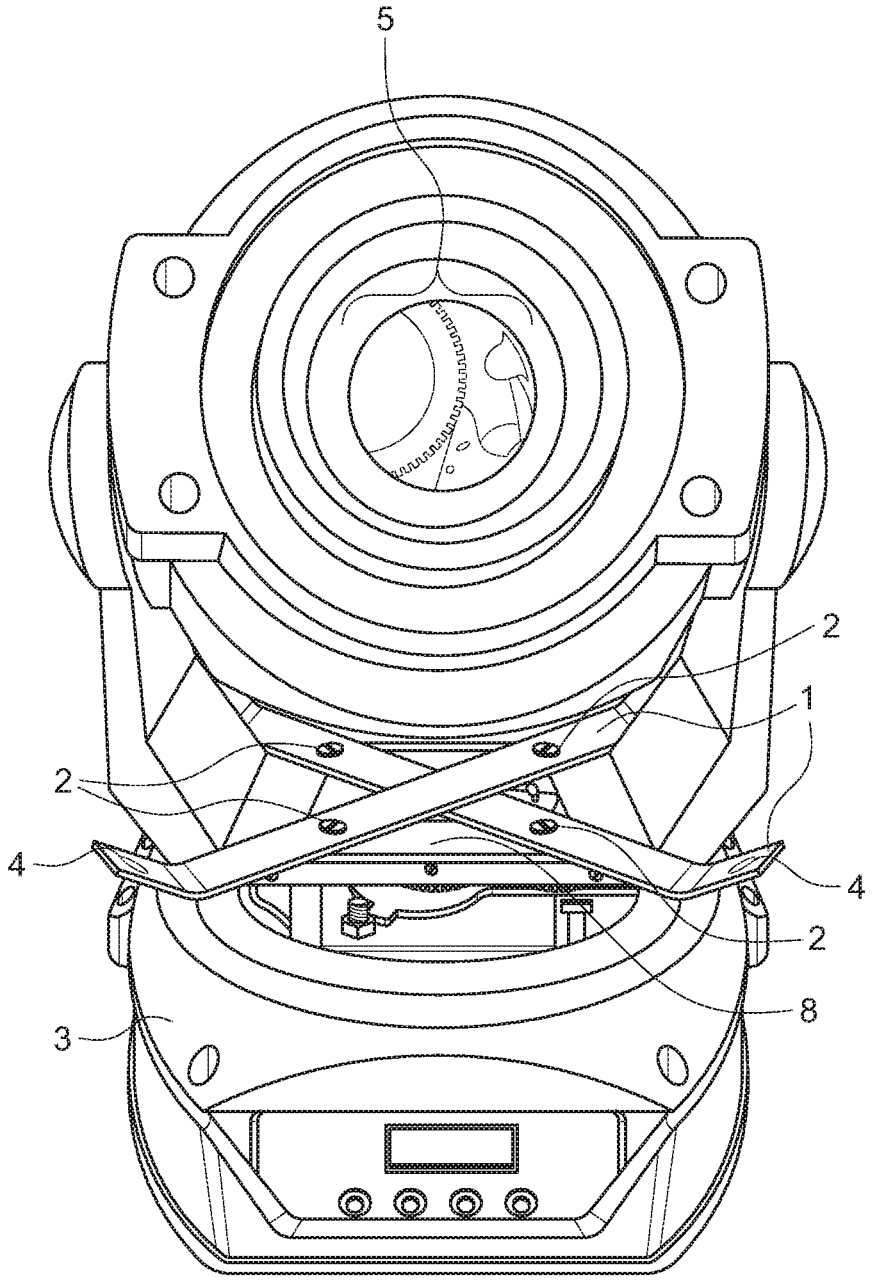
Figure 2:
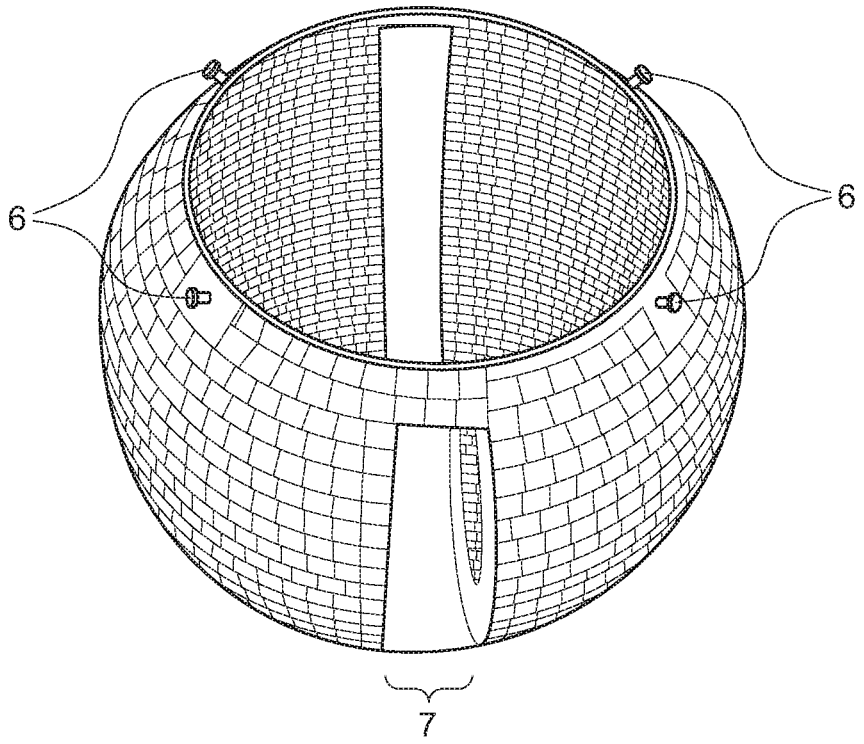
Figure 3:
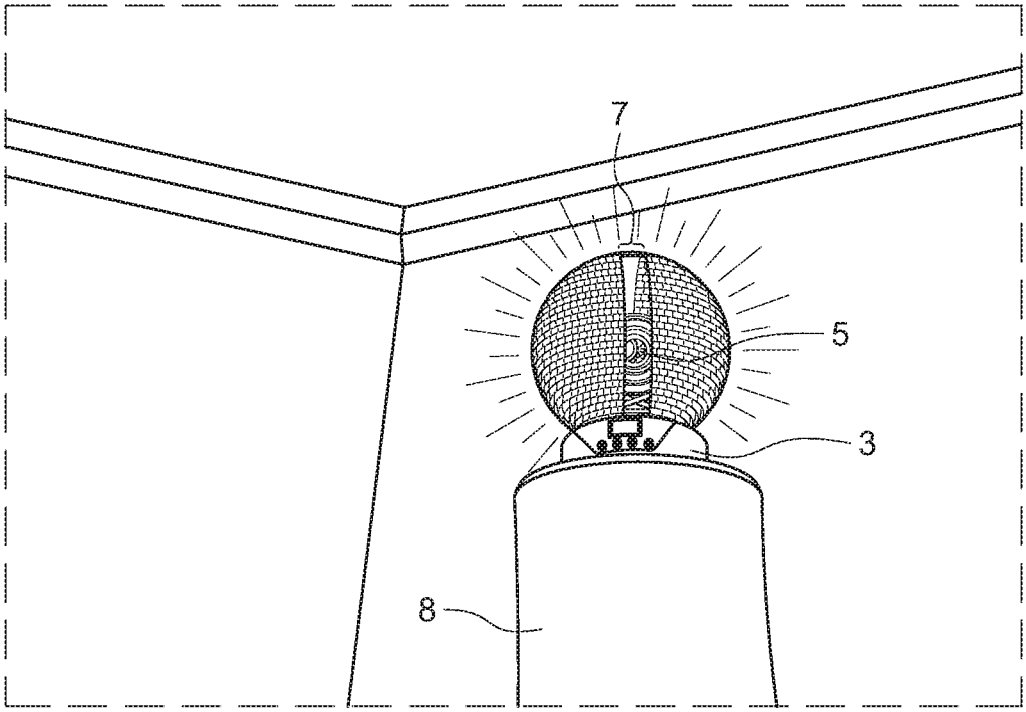
Figure 4:
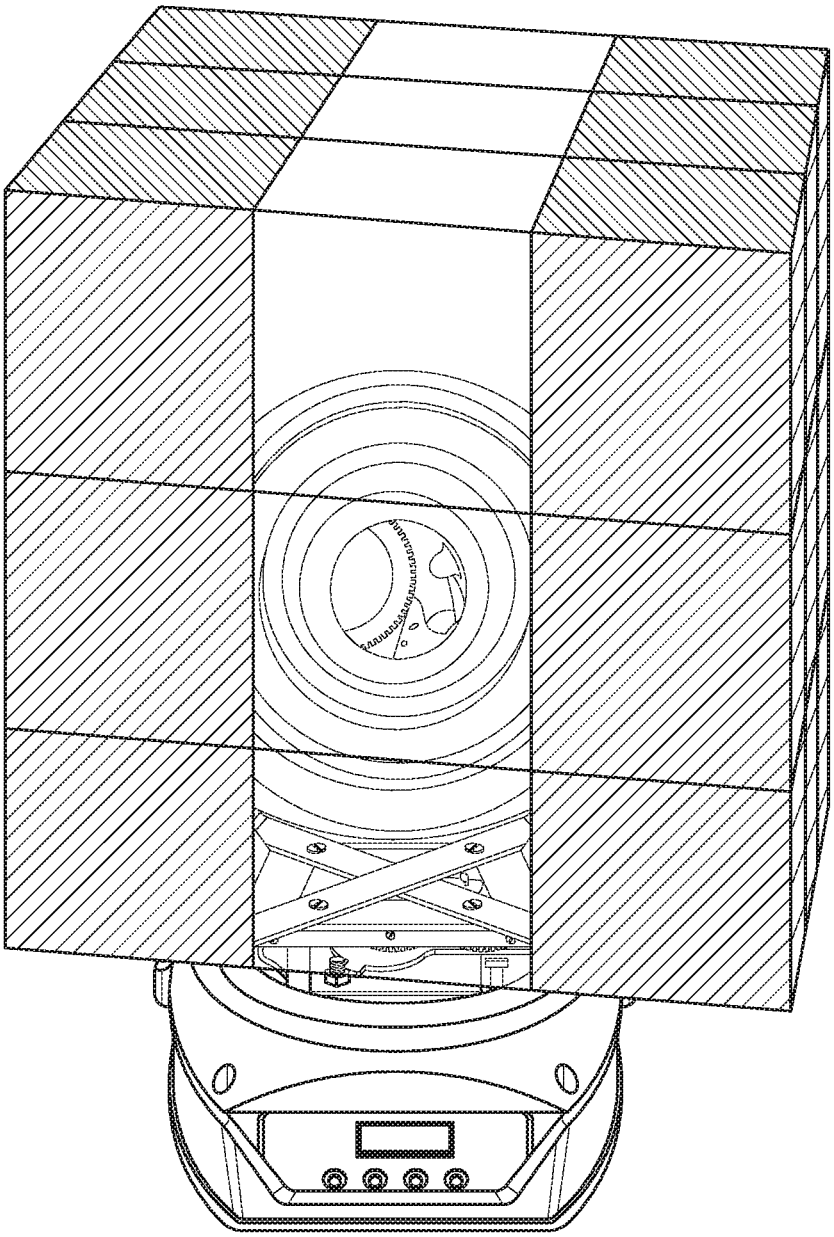

FIG. Three depicts the invention in use to enhance the ambiance and decor.

FIG. Four depicts the invention in use with a large cube as a decorative cover.

DETAILED DESCRIPTION OF PREFERRED EMBODIMENTS

The present invention are decorative covers for intelligent moving light fixtures.

These enclose the U-shaped, panning yoke as well as the football-shaped, tilting central light engine of an intelligent moving yoke light fixture. The cover is very loose-fitting in that it encloses all of the moving portion of the light but rotates with the panning yoke and that it has an opening, cut away or clear plastic strip running from low on one side, across the center top and down to the other side. This clear or open stripe is to allow the moving yoke intelligent lighting fixture within, to freely tilt from the fixtures's most extreme down position through the most extreme opposite tilt position, an open plan or axis down the middle of the cover design.

Each cover is attached to the respective light fixture with mounting brackets. The covers then mount overtop of the horizontally rotating portion of an intelligent yoke lighting fixture.

This cover is intended to mount on the yoke that moves in a rotational direction upon the base. The cover includes a cut or clear slot from one side up thru the center and down to the opposite side such that the beam(s) of light projected by the gimbled light projector inside the cover can exit the cover unencumbered.

The current invention enhances the light fixtures which it encloses, to an attractive set piece rather than just a functional light projector. The present invention adds to the decor rather than simply hide the lighting fixture amongst other decorative elements.

These covers cause the light fixture to become part of the scenery, adding to the visual appeal of the set. The present invention has numerous application for game show sets, clubs, concerts, bars, casinos, theme parks and other places where decorations are abundant.

Ventilation Holes

Heat accumulates and builds up from the lighting fixtures while in use.

In a preferred embodiment, the decorative covers have ventilation holes, slots, and gaps. around its base attachment region as well as at, around or near the top center of the shape. Regardless of the shape of the cover, the ventilation holes must be included within the design both around the base and the top of the cover to allow air flow. It is envisioned that the light fixtures may be installed upright or upside down in a hanging position. Accordingly, the ventilation holes must allow for the dissipation of the heat generated by the use of the enclose light fixture.

Mounting Brackets

There are currently over a hundred different commercially available moving yoke intelligent lighting fixture designs. One skilled in the art would need to take into account the specific design of the lighting fixture while installing the mounting brackets. Such concerns would include the overall balance of the enclosure on the lighting fixture, but also avoiding any impairment of the mobility.

Weight of the Enclosure

The extra added weight by the cover can negatively impact the moving yoke light fixture because its internal belt or motor may not be built for the extra weight. This could cause the rotating lighting fixture to fail or have reduced rotational speed.

In a preferred embodiment, the decorative cover is made of a light-weight material which does not impair the lighting fixture's movement and function, not tax its motor, belts, or gears.

Various Cover Designs

According to the invention, the covers enhance the overall decor. They provide auxiliary decorations to help the lighting fixture become part of an attractive set element and integrate into the overall set and theme of the rest of the display items.

A typical range of rotational positions of the yoke light range from 0 degrees thru 540 degrees including the ability, thru stepper motors, to precisely position the rotational position of the yoke.

The light beams for the fixture must remain uninhibited as the light exits the cover. This opening must be at least wide enough for the beam(s) of light generated from the enclosed light fixture to retain its function of projecting that beam uninhibited.

In a preferred embodiment, the remaining surface area of the cover is decorated such that the cover adds an attractive appeal and potential additional function to the fixture.

Preferably, these enclosures form a number of geometric shapes. These included spherical, cubical, cylindrical, half-sphere, or dodecahedron and the like. Additionally, the enclosures can form a "Death-Star," a spiked ball, or a robotic top. It is essential to the invention that any design provide enough volume to enclose a moving yoke lighting fixture.

In a preferred embodiment, the decorative cover is adorned with a mirror finish, painted, clear or even covered in multiple textures, illuminating LEDs, designs, art, etc.

Examples include a sphere covered in mirrors thereby appearing like a mirror or disco ball that reflects light.

In one embodiment, the invention is a spherical cover wrapped with addressable LED strips. This has the appearance of a "video wrapped globe".

In one embodiment, the invention is a cube shaped cover which can be decorated with dots to appear like a die or a toy puzzle cube.

In one embodiment, the invention is a spherical shape that may be decorated with lines, vinyl or paint to appear like a sports ball, a planet, movie object or, a TV show prop.

In one embodiment, the invention is the shape of an animal, a house or robot.

In one embodiment, the invention is a half-sphere decorated like the top of a robot.

These other embodiments may use a wire frame and stretched, flame-retardant cloth, mylar, or plastic.

The foregoing description comprises illustrative embodiments of the present invention.

As will be appreciated, the foregoing objects and examples are exemplary and embodiments need not meet all or any of the foregoing objects, and need not include all or any of the exemplary features described herein. Additional aspects and embodiments within the scope of the claims will be devised by those having skill in the art based on the teachings set forth herein.

While the invention has been described in connection with what are considered to be exemplary embodiments, it is to be understood that the invention is not limited to the disclosed embodiments, but on the contrary, is intended to cover various modifications and equivalent arrangements included within the spirit and scope of the appended claims.

Example One

Reference is made to FIG. One.

FIG. One depicts (Item #1) a pair of crossed mounting brackets secured onto (3) a standard intelligent moving light fixture. These crossed mounting brackets are secured to the panning plane (Item #8) of a standard intelligent moving light fixture through the use of (Item #2) four screws. The crossed mounting brackets themselves have four holes for the attachment of the decorative cover. Two of these holes are shown as Item #4. The light source for the standard intelligent moving light fixture is depicted as (Item #5).

In this example, the standard intelligent moving light fixture was a generic and unbranded production built in China that is common in the industry.

In this example, the mounting brackets ¾" metal, 16 gauge, cut, bent, and drilled to the fit the light fixture.

Reference is made to FIG. Two.

FIG. Two depicts the underside of a decorative cover according to the present invention. It depicts (Item #6) four screws along the horizontal mouth of the cover. Each of these will secure to the crossed mounting brackets at the four holes as depicted in Item #4. A vertical opening is depicted as Item #7. According to the invention, the light source for the standard intelligent moving light fixture (Item #5) must emit through this opening.

In this example, the frame of the cover was made from an acrylic sphere typically used in lighting, such as the top of a pole.

The cover is symmetrical side to side and front to back, but not top to bottom. In this example, vertical balance is not important, but a balance of weight on the panning plane is necessary.

Reference is made to FIG. Three.

FIG. Three depicts the invention in use. In particular, the (Item #5) light source for the standard intelligent moving light fixture is positioned so it is visible through (7) the vertical opening of the cover. This enables the light beam to be projected unobstructed. A supporting pedestal is shown as Item #8. The base of the standard intelligent moving light fixture is shown as Item #3.

Example Two

Reference is made to FIG. Four. This depicts the invention in use with a large cube as a decorative cover.

The invention claimed is:

1. A decorative cover for an intelligent moving yoke light fixture wherein said intelligent moving light fixture is a mirrored globe.

2. The decorative cover of claim 1 wherein:

said intelligent moving light fixture has at least two mounting brackets secured to a panning pane of said intelligent moving yoke light fixture;

each said mounting bracket has at least four screw holes for the securement of a decorative cover; and, said mounting brackets are secured to said decorative cover through a screw in each of said four screw holes.

3. The decorative cover of claim 1 wherein said mirrored globe has at least one ventilation hole.

4. The decorative cover of claim 3 wherein said mirrored globe has four ventilation holes.

5. A decorative cover for an intelligent moving yoke light fixture wherein:

said intelligent moving yoke light fixture has at least two mounting brackets secured to a panning pane of said intelligent moving yoke light fixture; and, said decorative cover has a single slot across the vertical axis through which an unobstructed beam of light emanates from said intelligent moving yoke light fixture.

6. The decorative cover of claim 5 wherein the intelligent moving yoke light fixture rotates.

7. The decorative cover of claim 5 wherein the single slot is open from one side up through the center and down the opposite side of said cover.

8. The decorative cover of claim 5 wherein the intelligent moving yoke light fixture is cube-shaped.

9. The decorative cover of claim 5 wherein the intelligent moving yoke light fixture is animal-shaped.

10. The decorative cover of claim 5 wherein the intelligent moving yoke light fixture is a half-sphere.

11. The decorative cover of claim 5 wherein the intelligent moving yoke light fixture is robot-shaped.

12. The decorative cover of claim 5 wherein the intelligent moving yoke light fixture is house-shaped.

* * * * *